US006264309B1

(12) United States Patent
Sullivan

(10) Patent No.: US 6,264,309 B1
(45) Date of Patent: Jul. 24, 2001

(54) FILTER FORMED AS PART OF A HEATER CHIP FOR REMOVING CONTAMINANTS FROM A FLUID AND A METHOD FOR FORMING SAME

(75) Inventor: Carl Edmond Sullivan, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 08/993,535

(22) Filed: Dec. 18, 1997

(51) Int. Cl.[7] ..... B41J 2/05; B41J 2/175
(52) U.S. Cl. ..... 347/63; 347/93
(58) Field of Search ..... 347/63, 65, 67, 347/93, 22, 64

(56) References Cited

U.S. PATENT DOCUMENTS

| | | | |
|---|---|---|---|
| 4,561,789 | 12/1985 | Saito | 400/120 |
| 4,639,748 | 1/1987 | Drake et al. | 347/93 |
| 4,864,329 | 9/1989 | Kneezel et al. | 347/93 |
| 5,124,717 | 6/1992 | Campanelli et al. | 347/93 |
| 5,141,596 | 8/1992 | Hawkins et al. | 347/93 |
| 5,154,815 | 10/1992 | O'Neill | 347/93 |
| 5,201,987 | 4/1993 | Hawkins et al. | 156/633 |
| 5,204,690 | 4/1993 | Lorenze, Jr. et al. | 347/93 |
| 5,308,442 | 5/1994 | Taub et al. . | |
| 5,443,713 | 8/1995 | Hindman | 205/70 |
| 5,537,136 | 7/1996 | Brandon et al. | 347/87 |
| 5,560,837 | 10/1996 | Trueba | 347/93 |
| 5,576,750 | 11/1996 | Brandon et al. | 347/87 |
| 5,610,645 * | 3/1997 | Moore et al. | 347/93 |
| 5,658,471 * | 8/1997 | Murthy et a. | 347/65 |
| 6,000,787 * | 12/1999 | Weber et al. | 347/65 |

FOREIGN PATENT DOCUMENTS

| | | |
|---|---|---|
| 0 360 580 A2 | 3/1990 | (EP) . |
| 0 518 467 A2 | 12/1992 | (EP) . |
| 0 750 992 A2 | 6/1995 | (EP) . |
| WO 95/13860 | 5/1995 | (WO) . |

OTHER PUBLICATIONS van Rijn, Cees et al., "Deflection and Maximum Load of Microfiltration Membrane Sieves Made with Silicon Micromachining", *Journal of Microelectromechanical Systems*, vol. 6, No. 1, Mar. 1997, pp. 48–54.

* cited by examiner

*Primary Examiner*—John Barlow
*Assistant Examiner*—Juanita Stephens
(74) *Attorney, Agent, or Firm*—John A. Brady

(57) ABSTRACT

An ink jet heater chip is provided having an integral filter for filtering contaminants from a fluid passing through the filter. The heater chip comprises a silicon substrate having opposing first and second surfaces and a passage extending through it. A first etch resistant material layer is formed on the first substrate surface and includes at least one opening which extends through the first layer and communicates with the substrate passage. A second etch resistant material layer is formed on the second substrate surface and includes a portion having a plurality of pores which extend through the second layer and communicate with the substrate passage. The portion of the second layer defines the filter which filters contaminaints from ink passing through the filter. A process for forming the heater chip is also provided.

48 Claims, 5 Drawing Sheets

FILTER FORMED AS PART OF A HEATER CHIP FOR REMOVING CONTAMINANTS FROM A FLUID AND A METHOD FOR FORMING SAME

CROSS-REFERENCE TO RELATED APPLICATION

This application is related to contemporaneously filed U.S. patent application Ser. No. 08/993,431, entitled "A Filter For Removing Contaminants From a Fluid and a Method For Forming Same," by Carl E. Sullivan, the disclosure of which is incorporated herein by reference.

FIELD OF THE INVENTION

This invention relates to a filter formed as an integral part of a heater chip for filtering contaminants from ink prior to the ink flowing to bubble chambers in a printhead.

BACKGROUND OF THE INVENTION

Drop-on-demand ink jet printers use thermal energy to produce a vapor bubble in an ink-filled chamber to expel an ink droplet. A thermal energy generator or heating element, usually a resistor, is located in the chamber on a heater chip near a discharge orifice or nozzle. A plurality of chambers, each provided with a single heating element, are provided in the printer's printhead. The printhead typicadly comprises the heater chip and a plate having a plurality of the discharge orifices formed therein. The printhead forms part of an ink jet print cartridge which also comprises an ink-filled container.

The print cartridge container includes one or more ink chambers. For a monochrome or single color print cartridge, one chamber is provided. For a three color print cartridge, three chambers are included. The print cartridge container may also include a filter/standpipe assembly for each chamber. The standpipe defines a passageway through which ink flows as it travels from the chamber to the printhead. The filter is attached to the standpipe and functions to remove air bubbles and contaminants from the ink before the ink reaches the printhead. Contaminants, if not removed from the ink, may block orifices in the printhead orifice plate, thereby preventing ink from being ejected from those orifices.

The quality of printed images produced by an ink jet printer depends to a large degree on the resolution of the printer. Higher or finer resolution wherein the dots are more closely spaced provides for higher quality images.

A consideration with increasing the resolution of ink jet printers is that increased resolution results in more printed dots per unit area. For example, doubling print resolution from 600×600 dpi to 1200×1200 dpi results in four times as many dots per unit area. Since the number of dots per unit area increases with increased resolution, the size of each printed dot must decrease in order to avoid saturating the print media. Hence, the size of the orifices in the orifice plate must decrease. In order to prevent the smaller orifices from becoming blocked or obstructed by contaminants contained in ink, finer filters are required.

Conventional filters attached to standpipes are typically made from a metal mesh. It is believed that very fine metal mesh filters would be costly to produce. Further, it is believed that ink pressure drop across a very fine metal mesh filter would be large due to the meandering flow path the ink must take as it passes through the metal mesh.

U.S. Pat. Nos. 5,124,717, 5,141,596 and 5,204,690 teach providing filters in silicon channel plates. In these printhead devices, two separate silicon substrates are required, one for the heater chip and one for the channel plate. Because silicon is an expensive material, these printhead devices are believed to be impractical.

Accordingly, there is a need for an improved low cost filter which is capable of removing particles of varying sizes including very small particles from ink without also effecting a large drop in fluid pressure across the filter.

SUMMARY OF THE INVENTION

With the present invention, a heater chip is provided having a filter formed as an integral part of the heater chip. The filter is capable of removing particles of varying sizes including very small particles from ink without effecting a large drop in fluid pressure across the filter. The heater chip of the present invention is formed from a silicon substrate having first and second etch resistant material layers on its opposing sides. A portion of the second layer includes a plurality of pores, each preferably having an area or size of between about 0.5 $\mu m^2$ and about 25 $\mu m^2$. The second layer portion defines a filter which filters contaminants from ink passing through the filter. In contrast to conventional metal mesh filters, the filter of the present invention has a direct flow path. Hence, the resistance to ink flow through the filter and the pressure drop across the filter are minimal.

In one embodiment of the present invention, the second layer portion includes two or more filter sections, each comprising a plurality of pores. The second layer portion further includes at least one reinforcement rib positioned between the two filter sections.

DETAILED DESCRIPTION OF PREFERRED EMBODIMENTS

Figure 1:
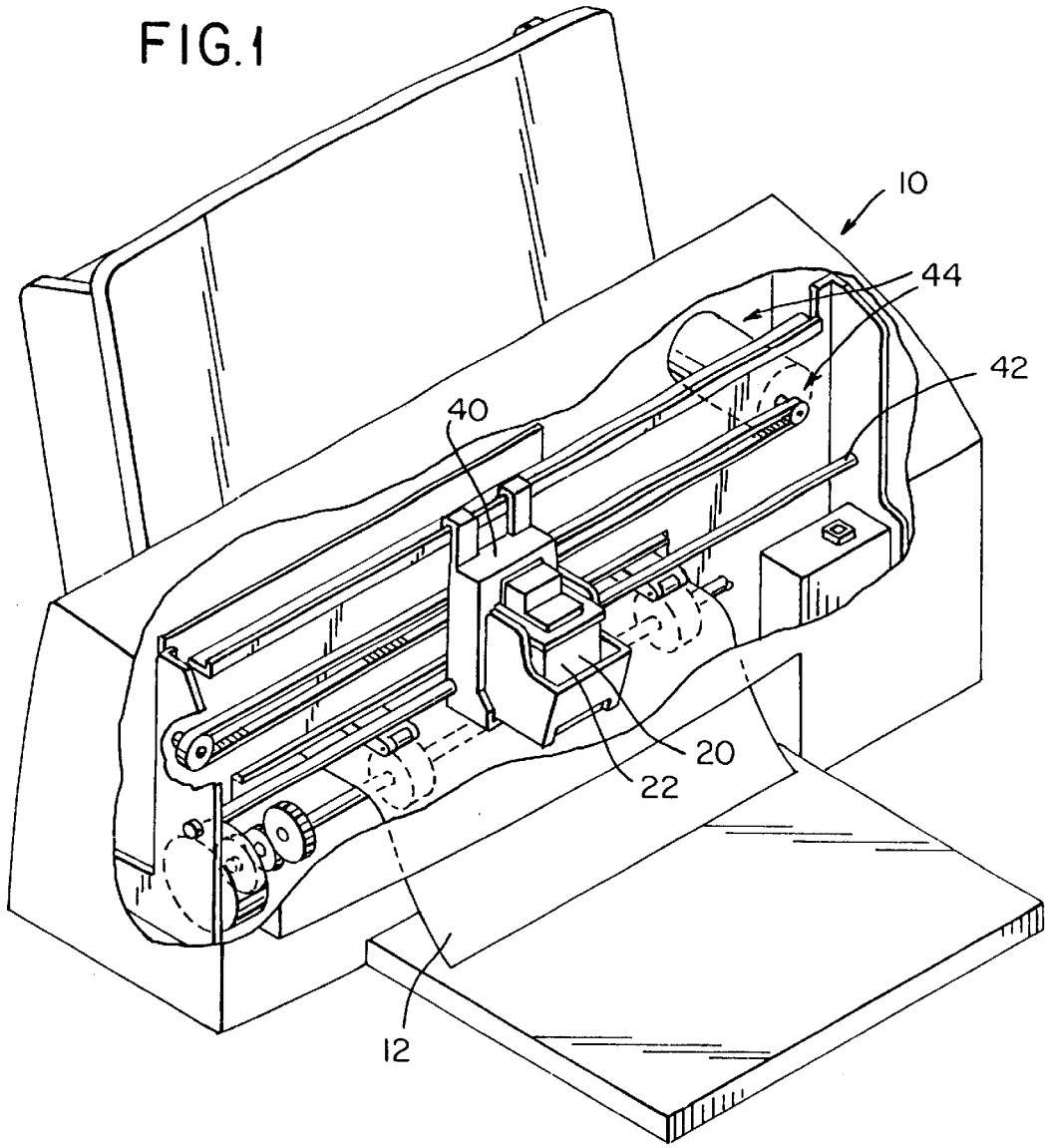
FIG. 1 is a perspective view, partially broken away, of an ink jet printing apparatus having a print cartridge constructed in accordance with the present invention.

Referring now to FIG. 1, there is shown an ink jet printing apparatus 10 having a print cartridge 20 constructed in accordance with the present invention. The cartridge 20 is supported in a carrier 40 which, in turn, is slidably supported on a guide rail 42. A drive mechanism 44 is provided for effecting reciprocating movement of the carrier 40 and the print cartridge 20 back and forth along the guide rail 42. As the print cartridge 20 moves back and forth, it ejects ink droplets onto a paper substrate 12 provided below it.

Figure 2:
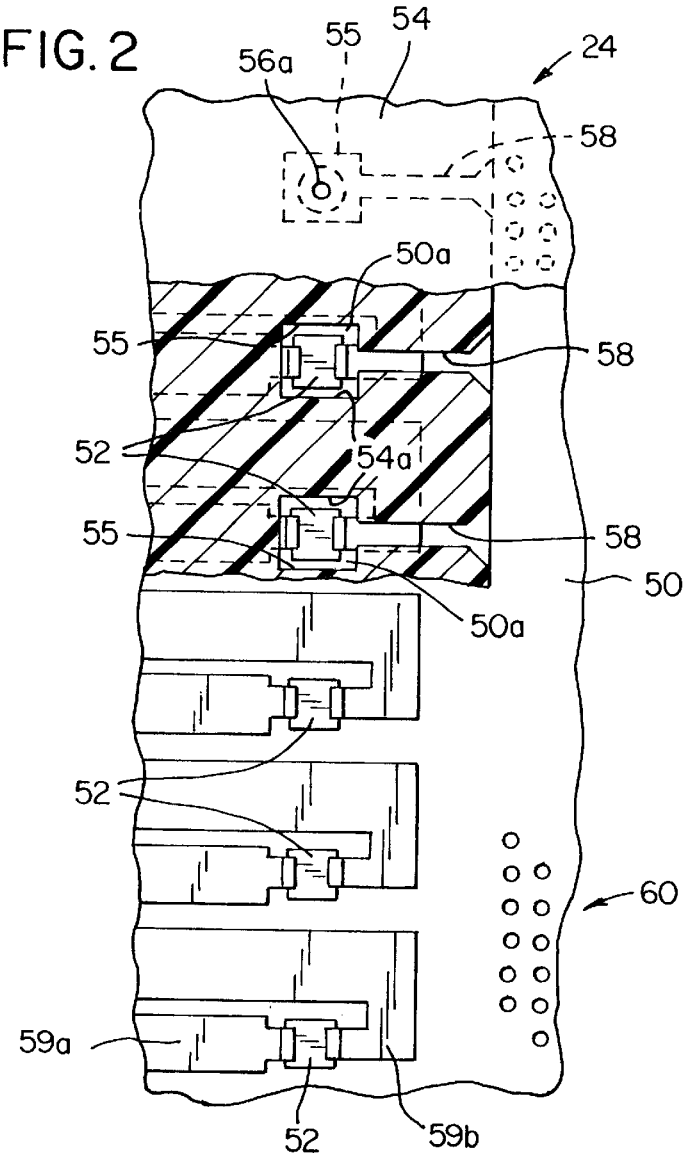
FIG. 2 is a view of a portion of a heater chip constructed in accordance with the present invention coupled to an orifice plate with sections of the orifice plate removed at two different levels.
Figure 3:
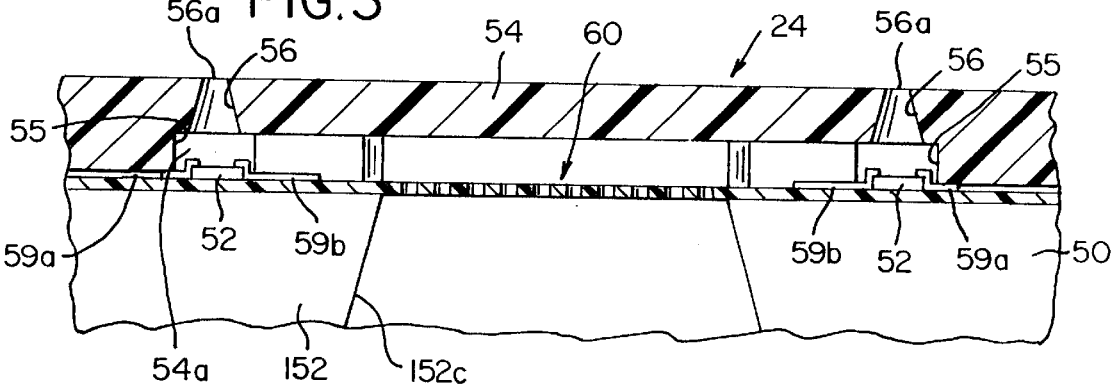
FIG. 3 is a cross sectional view of a portion of a printhead formed in accordance with a first embodiment of the present invention.

The print cartridge 20 comprises a container 22, see FIG. 1, and a printhead 24, see FIGS. 2 and 3, which is adhesively bonded or otherwise secured to the container 22. The container 22 includes an internal chamber (not shown) filled with ink. It further includes an outlet (not shown) through which the ink flows to the printhead 24. The container 22 in the illustrated embodiment includes only one chamber. However, it is contemplated that the container 22 may include more than one chamber, e.g., three chambers. Such a container is disclosed in U.S. Pat. No. 5,576,750, the disclosure of which is incorporated herein by reference.

The container 22 may be formed from a polymeric material. In the illustrated embodiment, the container 22 is formed from polyphenylene oxide, which is commercially available from the General Electric Company under the trademark "NORYL SE-1." Other materials not explicitly set out herein may also be used.

The printhead 24 comprises a heater chip 50 having a plurality of resistive heating elements 52, see FIGS. 2 and 3. The printhead 24 further includes a plate 54 having a plurality of openings 56 extending through it which define a plurality of orifices 56*a* through which droplets are ejected. The orifices 56*a* typically have a size (i.e., a diameter) of from about 5 $\mu$m to about 50 $\mu$m. The plate 54 may be bonded to the chip 50 via an adhesive. An example of such an orifice plate 54 and example adhesives are set out in commonly owned patent applications, U.S. Ser. No. 08/519,906, entitled "METHOD OF FORMING AN INKJET PRINTHEAD NOZZLE STRUCTURE," by Tonya H. Jackson et al., filed Aug. 28, 1995, and U.S. Pat. No. 6,120,131; entitled "METHOD OF FORMING AN INKJET PRINTHEAD NOZZLE STRUCTURE,' by Tonya H. Jackson et al., filed on Nov. 7, 1997, the disclosures of which are hereby incorporated by reference. As noted therein, the plate 54 may be formed from a polymeric material such as polyimide, polyester, fluorocarbon polymer, or polycarbonate, which is preferably about 15 to about 200 microns thick, and most preferably about 75 to about 125 microns thick.

When the plate 54 and the heater chip 50 are joined together, sections 54*a* of the plate 54 and portions 50*a* of the heater chip 50 define a plurality of bubble chambers 55. Ink supplied by the container 22 flows into the bubble chambers 55 through ink supply channels 58. The resistive heating elements 52 are positioned on the heater chip 50 such that each bubble chamber 55 has only one heating element 52. Each bubble chamber 55 communicates with one orifice 56*a*, see FIG. 3.

The resistive heating elements 52 are individually addressed by voltage pulses. Each voltage pulse is applied to one of the heating elements 52 to momentarily vaporize the ink in contact with that heating element 52 to form a bubble within the bubble chamber 55 in which the heating element 52 is located. The function of the bubble is to displace ink within the bubble chamber 55 such that a droplet of ink is expelled from an orifice 56*a* associated with the bubble chamber 55.

A flexible circuit (not shown) secured to the container 22 is used to provide a path for energy pulses to travel from a printer energy supply circuit to the heater chip 50. Bond pads (not shown) provided on the heater chip 50 are bonded to end sections of traces (not shown) on the flexible circuit. The bond pads are coupled to first and second conductors 59*a* and 59*b* on the heater chip 50, see FIG. 2. Current flows from the printer energy supply circuit to the traces on the flexible circuit and from the traces to the bond pads on the heater chip 50. From the bond pads, the current flows through the conductors 59*a* and 59*b* and the heating elements 52.

In accordance with the present invention, a filter 60 is formed as an integral part of the heater chip 50, see FIGS. 2–5. The heater chip 50 comprises a silicon substrate 152 having opposing first and second outer surfaces 152*a* and 152*b*, respectively, and a passage 152*c* extending completely through it. The substrate 152 has a length $L_S$ of from about 500 $\mu$m to about 50800 $\mu$m, and preferably about 4000 $\mu$m; a width $W_S$ of from about 500 $\mu$m to about 50800 $\mu$m, and preferably about 12000 $\mu$m; and, a thickness $T_S$ of from about 25 $\mu$m to about 2 mm, and preferably about 525 $\mu$m, see FIGS. 4 and 5. The passage 152*c* is rectangular in shape where it meets the second outer surface 152*b*. It may also be square, oval, elliptical, or have any other geometric shape. At the second outer surface 152*b*, the passage 152*c* has a length $L_P$ of from about 50 $\mu$m to about 37250 $\mu$m, and preferably about 350 $\mu$m, and a width $W_P$ of from about 50 $\mu$m to about 37250 $\mu$m, and preferably about 2930 $\mu$m.

Figure 5:
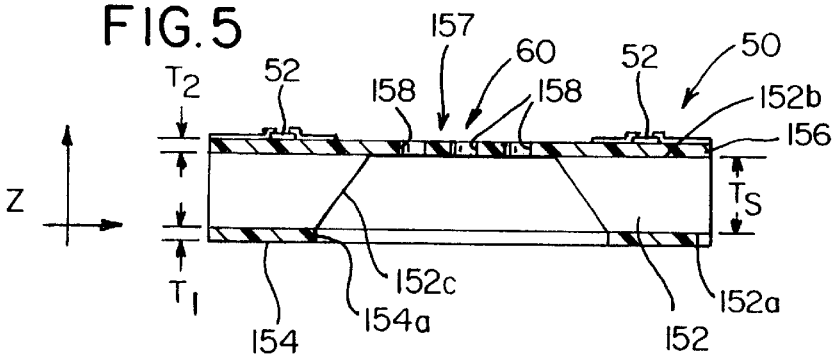
FIG. 5 is a schematic cross sectional view of a heater chip formed in accordance with a first embodiment of the present invention.

A first etch resistant material layer 154 is formed on the first substrate surface 152*a*, see FIG. 5. The first layer 154 includes an opening 154*a* extending completely through it which communicates with the substrate passage 152*c*. The opening 154*a* has generally the same shape (e.g., rectangular) and size as the passage 152*c* at the first outer surface 152*a*. The first layer 154 has a thickness $T_1$ in the Z-direction, see FIG. 5, of from about 1 $\mu$m to about 20 $\mu$m, including all ranges subsumed therein, and preferably from about 1 $\mu$m to about 2.5 $\mu$m. The first layer 154 may be formed from any one of a number of known etch resistant materials including, for example, silicon nitride, silicon carbide, aluminum, tantalum, and silicon dioxide. Other materials not explicitly set out herein may also be used when forming the layer 154.

Figure 4:
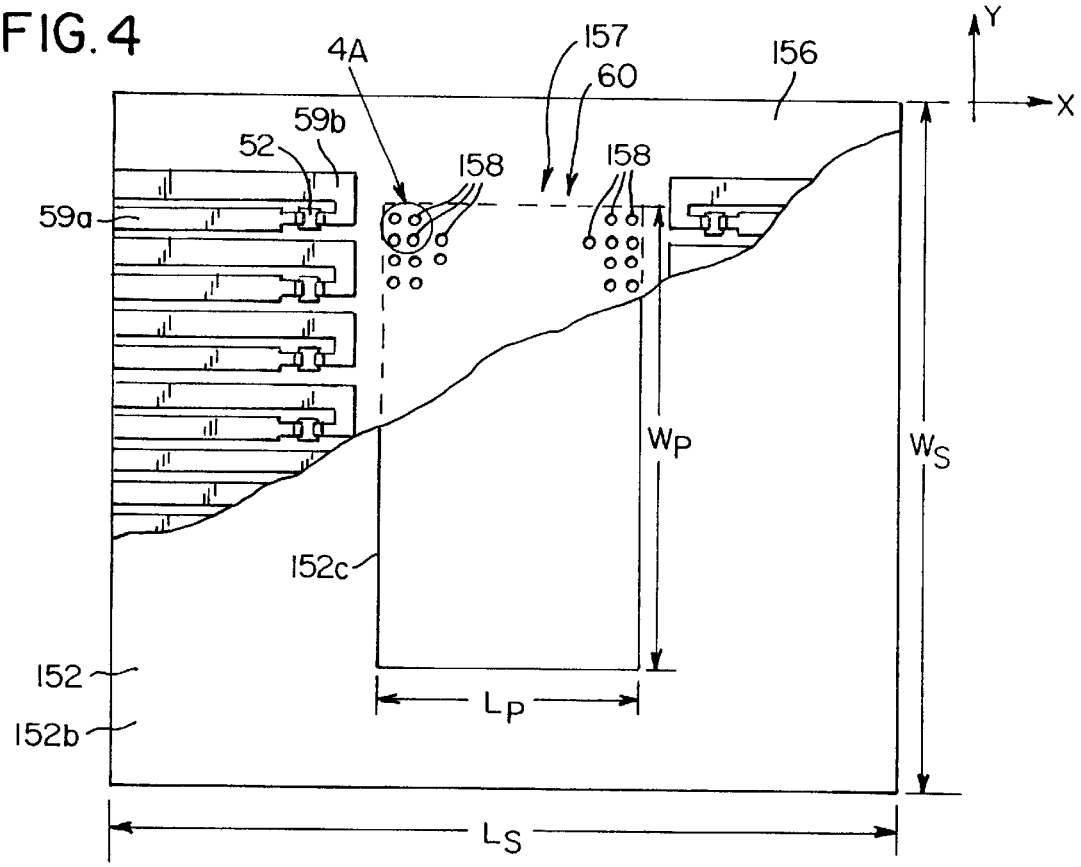
FIG. 4 is a plan view, partially broken away, of a heater chip constructed in accordance with a first embodiment of the present invention.
Figure 4A:
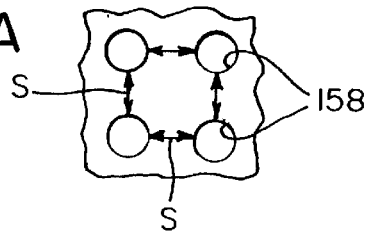
FIG. 4A is an enlarged view of a portion of the heater chip illustrated in FIG. 4.

A second etch resistant material layer 156 is formed over the second substrate surface 152*b*. In the illustrated embodiment, the second layer 156 is formed directly on the second surface 152*b*. However, the second layer 156 may be formed on an intermediate layer (not shown) positioned between the layer 156 and the second substrate surface 152*b*. The second layer 156 includes a central portion 157 having a plurality of pores 158 extending completely through it which communicate with the substrate passage 152*c*. If the second layer 156 is formed over an intermediate layer, and the intermediate layer has a central portion which is essentially coextensive with the central portion 157, the intermediate layer will also have pores formed in it which correspond to the pores in the second layer 156. It is also contemplated that the second layer 156 may be formed over a different intermediate layer having a single open area which is essentially coextensive with the central portion 157. Hence, this different intermediate layer does not include a plurality of pores. The second layer pores 158 have an area or size in an X-Y plane, see FIG. 4, of from about 0.5 $\mu m^2$ to about 25 $\mu$m, including all ranges subsumed therein; and preferably, from about 0.5 $\mu m^2$ to about 17 $\mu m^2$; more preferably, from about 1.0 $\mu m^2$ to about 8 $\mu m^2$; and most preferably from about 1.0 $\mu$to about 5 $\mu m^2$. The spacing S between adjacent pores 158 is from about 1 $\mu$m to about 50 μm, and preferably about 6 μm, see FIG. 4A. The second layer 156 has a thickness $T_2$ in the Z-direction, see FIG. 5, of from about 1 μm to about 20 μm, including all ranges subsumed therein, preferably, from about 1.0 μm to about 5.0 μm, and most preferably from about 1.0 μm to about 2.5 μm. The second layer central portion 157 defines the filter 60. It functions to filters air bubbles and contaminants from ink before the ink passes into the ink supply channels 58, see FIG. 3. The second layer 156 may be formed from any one of a number of known etch resistant materials including, for example, silicon nitride, silicon carbide, and silicon dioxide. Other materials not explicitly set out herein may also be used when forming the layer 156.

Figure 5A:
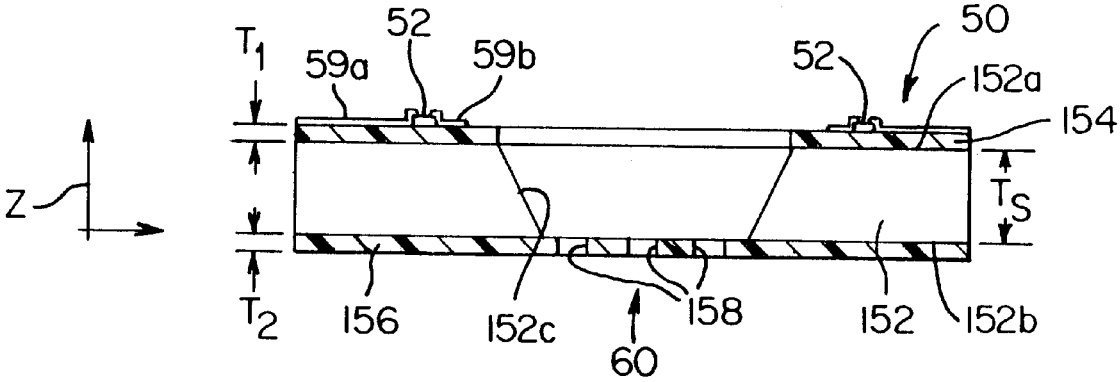
FIG. 5A is a schematic cross sectional view of a heater chip formed in accordance with an alternative embodiment of the present invention.

The heating elements 52 and the first and second conductors 59*a* and 59*b* may be formed over the second etch resistant material layer 156. In the illustrated embodiment, they are formed directly on the second layer 156. When the heating elements 52 and the conductors 59*a* and 59*b* are formed directly on the second etch resistant material layer 156, the second layer 156 is preferably formed from a dielectric material. Transistors (not shown) or other circuit elements may also be formed on the second layer 156. Alternatively, the heating elements 52 and the conductors 59*a* and 59*b* may be formed over the first etch resistant material layer 154, see FIG. 5A. When the heating elements 52 and the conductors 59*a* and 59*b* are formed directly on the first etch resistant material layer 154, the first layer 154 is preferably formed from a dielectric material. It is also contemplated that the heating elements 52 and the conductors 59*a* and 59*b* may be formed on a layer other than the first and second etch resistant material layers 154 and 156. For example, one or more other layers may be formed over or under portions of the second etch resistant material layer 156. The heating elements 52 and the conductors 59*a* and 59*b* may be formed on one of those additional layers provided over or under the second layer 156. Similarly, one or more other layers may be formed over or under portions of the first etch resistant material layer 154. The heating elements 52 and the conductors 59*a* and 59*b* may be formed on one of those additional layers provided over or under the first layer 154. It is further contemplated that the heating elements 52 may be formed on a first side of one of the first layer 154 and the second layer 156 while the conductors 59*a* and 59*b* are formed on the other side of the one layer.

Figure 7:
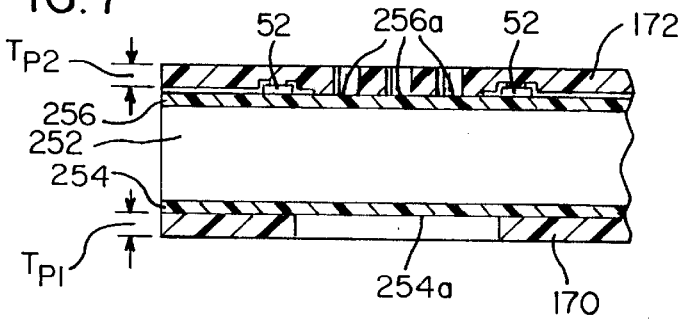
Figure 8:
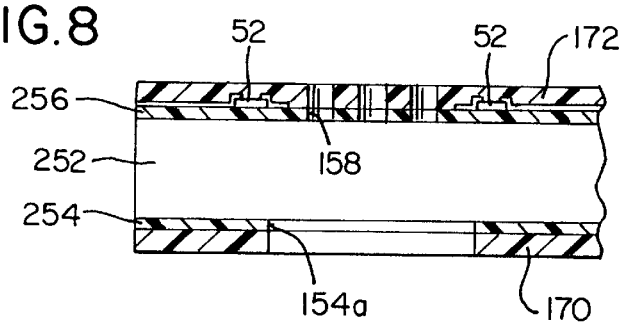

The process for forming the heater chip 50 will now be described with reference to FIGS. 6–8. A silicon wafer 252 having a thickness $T_S$ of from about 400 μm to about 650 μm is provided. The thickness of the wafer 252 is not critical and may fall outside of this range. A plurality of heater chips 50 are formed on a single wafer 252. For ease of illustration, only a portion of the wafer 252 is illustrated in FIGS. 6–8.

Figure 6:
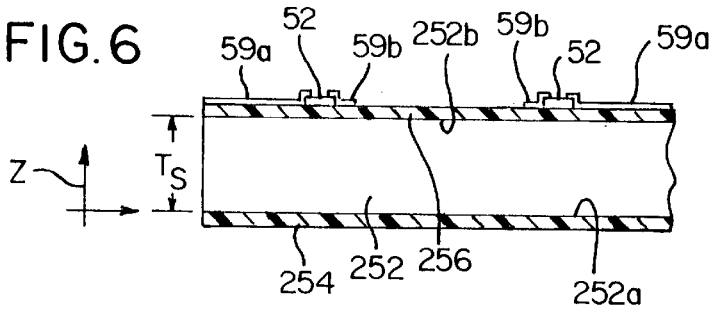
FIGS. 6–8 are schematic cross sectional views illustrating the process for forming the heater chip illustrated in FIG. 5.

A first etch resistant material layer 254 is formed on a first side 252*a* of the wafer 252, see FIG. 6. The layer 254 may be formed from any one of a number of known etch resistant materials including, for example, silicon nitride, silicon carbide, aluminum, tantalum, silicon dioxide, and the like. A second etch resistant material layer 256 is formed on a second side 252*b* of the wafer 252, see FIG. 6. In the illustrated embodiment, heating elements 52 and first and second conductors 59*a* and 59*b* are formed on the second etch resistant material layer 256 in a conventional manner. Hence, the second layer 256 is formed from a dielectric material. Transistors (not shown) or other circuit elements may also be formed on the second layer 256. In the illustrated embodiment, the first and second layers 254 and 256 comprise silicon nitride layers. The silicon nitride is deposited simultaneously onto the outer surfaces 252*a* and 252*b* of the wafer 252 using a conventional plasma enhanced chemical vapor deposition process. Alternatively, silicon dioxide layers may be thermally grown on the outer surfaces 252*a* and 252*b* of the wafer 252. It is also contemplated that silicon nitride may be deposited onto the outer surfaces 252*a* and 252*b* of the wafer 252 using a conventional low-pressure chemical vapor deposition process. However, if this latter process is used, the silicon nitride needs to be deposited before any metal layers are formed.

The first layer 254 has a thickness in the Z-direction, see FIG. 6, of from about 1.0 μm to about 20 μm, and preferably from about 1.0 μm to about 2.5 μm. The second layer 256 has a thickness in the Z-direction, see FIG. 6, of from about 1 μm to about 20 μm, and preferably, from about 1.0 μm to about 2.5 μm.

After the first and second layers 254 and 256 are deposited onto the wafer 252, a first photoresist layer 170 is formed over the first etch resistant material layer 254 via a conventional spinning process. The layer 170 has a thickness $T_{P1}$ of from about 100 Å to about 50 μm, and preferably from about 1.0 μm to about 5.0 μm, see FIG. 7. The photoresist material may be a negative or a positive photoresist material. In the illustrated embodiment, the layer 170 is formed from a negative photoresist material which is commercially available from Olin Microelectronic Materials under the product designation "SC-100 Resist." After the first layer 170 is spun onto the wafer 252, it is softbaked at an appropriate temperature so as to partially evaporate photoresist solvents to promote adhesion of the layer 170 to the wafer 252. A further reason for softbaking the first layer 170 is to prevent a first mask, to be discussed below, from adhering to the first layer 170.

A first mask (not shown), having a plurality of blocked or covered areas corresponding to the first layer openings 154*a* in the heater chips 50, is positioned over the first photoresist layer 170. The first mask is aligned in a conventional manner. For example, the first mask may be formed with one or more alignment markers that are aligned with one or more alignment marks (not shown) formed on the second etch resistant material layer 256. The alignment marks on the second etch resistant material layer 256 may be created from the same material and during the same process step as the conductors 59*a* and 59*b*. A conventional infra-red mask aligner or a double-sided mask aligner is used to effect alignment of the one or more alignment markers on the second mask with the one or more alignment marks on the second material layer 256.

Unblocked portions of the first photoresist layer 170 are exposed to ultraviolet light so as to effect curing or polymerization of the exposed portions. The first mask is then removed. Thereafter, the unexposed or uncured portions of the first photoresist layer 170 are removed using a conventional developer chemical. In the illustrated embodiment, the unpolymerized portions are removed by spraying a developer, such as one which is commercially available from Olin Microelectronic Materials under the product designation "PF developer," onto the first wafer side while the wafer 252 is spinning. After the development process has been initiated, a mixture of about 90% developer chemical and 10% isopropyl alcohol, by volume, is sprayed onto the first side of the spinning wafer 252. Finally, the development process is stopped by spraying only isopropyl alcohol onto the spinning wafer 252. As can be seen in FIG. 7, after the unpolymerized portions of the first photoresist layer 170 are removed from the wafer 252, portions 254*a* (only one portion is illustrated in FIG. 7) of the first etch resistant material layer 254 are exposed.

Instead of spraying the three different development compositions onto the wafer 252, the wafer 252 may be placed sequentially in three different baths containing, respectively, 100% developer, a mixture of about 90% developer and 10% isopropyl alcohol, and 100% isopropyl alcohol. The wafer 252 remains in the first bath until the development process has been initiated. It is then placed in the second bath. It is removed from the second bath and placed in the third bath after the unpolymerized portions of the first layer 170 have been removed. The wafer 252 is preferably agitated when in each of the baths.

Next, a second photoresist layer 172 is formed over the second etch resistant material layer 256 via a conventional spinning process. The layer 172 has a thickness $T_{P2}$ of from about 100 Å to about 50 $\mu$m, and preferably from about 1.0 $\mu$m to about 5.0 $\mu$m. The photoresist material from which the layer 172 is formed may be a negative or a positive photoresist material. In the illustrated embodiment, the laser 172 is formed from the same material as the first layer 170. After the second layer 172 is spun onto the wafer 252, it is softbaked at an appropriate temperature so as to partially evaporate photoresist solvents to promote adhesion of the layer 172 to the layer 256.

A second mask (not shown), having a plurality of blocked or covered areas which correspond to the second layer pores 158 in the heater chips 50, is positioned over the second photoresist layer 172. Blocked areas in the second mask are preferably formed only in portions of the second mask that are generally coextensive with or slightly smaller or larger than the portions having blocked areas in the first mask. As such, each heater chip 50 will be formed having pores 158 only in the central portion 157 of the second layer 156, i.e., the portion that extends over the substrate passage 152*c*.

The second mask is aligned in a conventional manner. For example, the second mask may be formed with one or more alignment markers that are aligned with one or more of the alignment marks (not shown) formed on the second etch resistant material layer 256. A conventional mask aligner is used to effect alignment of the one or more alignment markers on the second mask with the one or more alignment marks on the second material layer 256.

Unblocked portions of the second photoresist layer 172 are exposed into ultraviolet light so as to effect curing or polymerization of the exposed portions. The second mask is then removed. The unpolymerized portions of the second photoresist layer 172 are removed in the same manner as the unpolymerized portions of the first photoresist layer 170. As can be seen in FIG. 7, after the unpolymerized portions of the second photoresist layer 172 are removed from the wafer 252, portions 256*a* of the second etch resistant material layer 256 are exposed.

Following the development of the second photoresist layer 172, the first and second layers 170 and 172 are hardbaked in a conventional manner so as to effect final evaporation of solvents in those layers 170 and 172.

The patterns formed in the first and second photoresist layers 170 and 172 are transferred to the first and second etch resistant material layers 254 and 256, see FIG. 8, using a conventional etching process. For example, a conventional reactive ion etching process using a reactive ion etcher may be used. When the first and second etch resistant material layers 254 and 256 are formed from silicon nitride, the reactive gas supplied to the reactive ion etcher is $CF_4$.

After the patterns have been transferred to the first and second etch resistant material layers 254 and 256, the polymerized photoresist material remaining on the wafer 252 is removed in a conventional manner. For example, a conventional reactive ion etcher receiving an $O_2$ plasma may be used. Alternatively, a commercially available resist stripper, such as one which is commercially available from Olin Microelectronic Materials under the product designation "Microstrip," may be used.

Finally, a micromachining step is implemented to form the substrate passages 152*c* in the silicon wafer 252. This step involves placing the wafer 252 in an etchanit bath for a sufficient period of time to etch away a sufficient amount of silicon such that the passages 152*c* are formed. A tetramethyl ammonium hydroxide (TMAH) based bath is preferably used. The TMAH based bath comprises, by weight percent, from about 5% to about 40%, and preferably about 10% tetramethyl ammonium hydroxide, and from about 60% to about 95%, and preferably about 90%, water. The TMAH/water solution is passivated by dissolving silicon and/or silicic acid into the TMAH/water solution until the solution has a pH of from about 11 to about 13. A more detail discussion of passivating TMAH solutions can be found in the paper: U. Schnakenberg, W. Benecke, and P. Lange, *THAHW Etchants for Silicon Micromachining*," In Proc. Int. Conf. on Solid State Sensors and Actuators (Transducers 1991), pages 815–818, San Francisco, June, 1991, the disclosure of which is incorporated herein by reference. The passivated TMAH/water solution is advantageous as it does not attack exposed metal layers, conductors or devices formed on the wafer 252. When sufficient etching has occurred such that the silicon substrate passages 152*c* are formed, see FIG. 5, the wafer 252 is removed from the bath.

Thereafter, the wafer 252 is diced into individual heater chips 50.

The sequence of the above steps may vary. For example, the first pattern as defined by the developed first photoresist layer 170 may be transferred to the first etch resistant material layer 254 using a conventional etching process and the first photoresist layer 170 removed before the second photoresist layer 172 is formed on the second etch resistant material layer 256. It is also contemplated that the second photoresist layer 172 may be formed over the second etch resistant material layer 256, softbaked, exposed to ultraviolet light and developed before the first photoresist layer 170 is formed over the first etch material layer 254.

Figure 9:
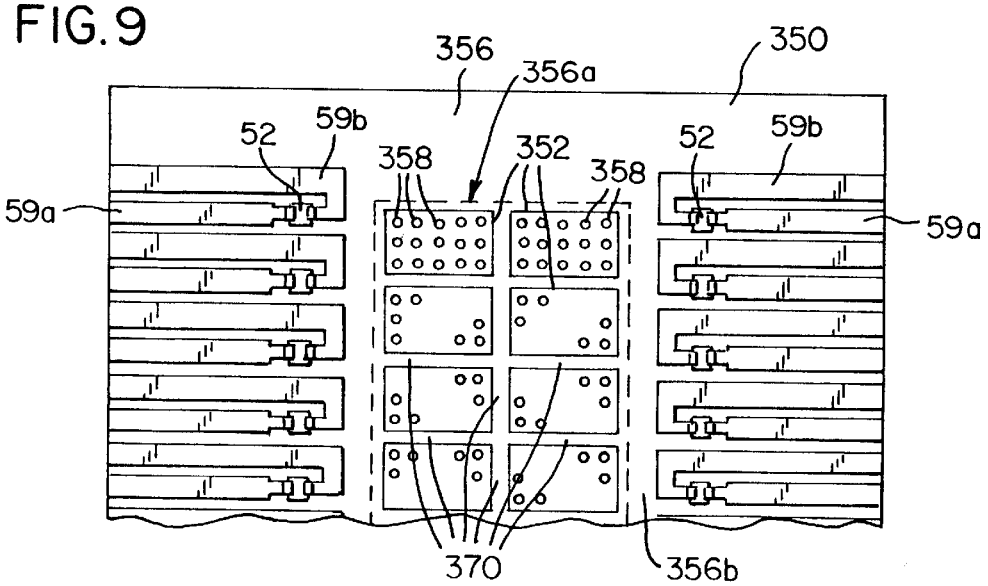
FIG. 9 is a plan view of a portion of a heater chip formed in accordance with a second embodiment of the present invention.

A heater chip 350, formed in accordance with a second embodiment of the present invention, is shown in FIG. 9, where like reference numerals indicate like elements. In this embodiment, the second etch resistant material layer 356 includes a first portion 356*a* having a plurality of filter sections 352 separate by reinforcement ribs 370. Each filter section 352 includes a plurality of pores 358. In the illustrated embodiment, a second remaining portion 356*b* of the second layer 356 beyond the first portion 356*a* does not include pores 358. By providing one or more reinforcement ribs 370 in the second layer 356, the thickness of the second layer 356 may be reduced, thereby reducing fluid pressure drop across the filter sections 352. Preferably, the thickness of the second layer 356 is about 1.0 $\mu$m. At that thickness, it is believed that the pressure drop across the filter sections 352 is negligible.

What is claimed is:

1. A heater chip comprising:

a silicon main body portion having an opposing first surface and second surface and a passage extending therethrough;

a first etch resistant material layer formed on said first surface and including at least one opening which extends through said first layer and communicates with said passage;

a second etch resistant material layer integrally formed on said second surface and including a plurality of pores extending through said second layer and communicating with said passage, said second layer defining a filter which filters contaminants from ink passing through said second layer;

at least one heating element formed over said second layer; and at least two conductors associated with said at least one heating element for providing energy to said at least one heating element.

2. A heater chip as set forth in claim 1, wherein said heating element and said conductors are formed on said second layer.

3. A heater chip as set forth in claim 1, wherein said pore size is between about 0.5 $\mu m^2$ and about 25 $\mu m^2$.

4. A heater chip as set forth in claim 1, wherein said second layer has a thickness of from about 1 $\mu$m to about 20 $\mu$m.

5. A heater chip as set forth in claim 1, wherein the spacing between adjacent pores is from about 1 $\mu$m to about 50 $\mu$m.

6. A heater chip as set forth in claim 5, wherein said second layer has a thickness of from about 1 $\mu$m to about 2.5 $\mu$m.

7. A heater chip as set forth in claim 1, wherein said pore size is from about 1 $\mu m^2$ to about 5 $\mu m^2$.

8. A heater chip as set forth in claim 7, wherein said second layer has a thickness of from about 1 $\mu$m to about 2.5 $\mu$m.

9. A heater chip as set forth in claim 1, wherein at least one of said first layer and said second layer is formed from a material selected from the group consisting of silicon nitride, silicon carbide, aluminum, tantalum, and silicon dioxide.

10. A heater chip as set forth in claim 1, wherein said second layer further includes at least one reinforcement rib positioned between two filter sections.

11. A heater chip as set forth in claim 1, wherein only a portion of said second etch resistant material layer includes pores.

12. A heater chip as set forth in claim 11, wherein said second layer portion includes two or more filter sections each comprising a plurality of said pores, said second layer portion further including at least one reinforcement rib positioned between said two filter sections.

13. A method for forming a heater chip comprising the steps of:

providing a silicon substrate having an opposing first surface and second surface;

forming a first etch resistant material layer on said first substrate surface, said first layer including at least one opening which extends through said first layer;

forming a second etch resistant material layer on and integrally with said second substrate surface, said second layer including a plurality of pores extending through said second layer for filtering ink passing through said second layer;

forming at least one heating element and at least two conductors over said second silicon substrate surface energy to said at least one heating element; and forming at least one passage through said silicon substrate which communicates with said opening in said first layer and at least a portion of said pores in said second layer.

14. A method as set forth in claim 13, wherein said pores have a size of from about 0.5 $\mu m^2$ to about 25 $\mu m^2$.

15. A method as set forth in claim 13, wherein said pores have a size of from about 1 $\mu m^2$ to about 17 $\mu m^2$.

16. A method as set forth in claim 15, wherein said second layer has a thickness of from about 1 $\mu$m to about 2.5 $\mu$m.

17. A method as set forth in claim 13, wherein said pore size is from about 1 $\mu m^2$ to about 5 $\mu m^2$.

18. A method as set forth in claim 17, wherein said second layer has a thickness of from about 1 $\mu$m to about 2.5 $\mu$m.

19. A method as set forth in claim 13, wherein said step of forming at least one passage in said silicon substrate comprises the step of etching away a portion of said silicon substrate using a tetramethyl ammonium hydroxide etching solution.

20. A method as set forth in claim 13, wherein said second layer includes at least one reinforcement rib positioned between two filter sections.

21. A method as set forth in claim 13, wherein said step of formiiag a second etch resistant material layer on said second substrate surface comprises the step of forming a second etch resistant material layer on said second substrate surface having pores in only a portion of said second etch resistant material layer.

22. A heater chip comprising:

a silicon main body portion having an opposing first surface and second surface and a passage extending therethrough;

a first etch resistant material layer formed on said first surface and including at least one opening which extends through said first layer and communicates with said passage;

a second etch resistant material layer integrally formed on said second surface and including a plurality of pores extending through said second layer and communicating with said passage, said pores having a size between about 0.5 $\mu m^2$ and about 5 $\mu m^2$, and said second layer defining a filter which filters contaminants from ink passing through said second layer;

at least one heating element formed over said silicon main body portion, and at least two conductors associated with said at least one heating element for providing energy to said at least one heating element.

23. A heater chip as set forth in claim 22, wherein said heating element and said conductors are formed over said first layer.

24. A heater chip as set forth in claim 23, wherein said heating element and said conductors are formed on said first layer.

25. A heater chip as set forth in claim 22 wherein said heating element and said conductors are formed over said second layer.

26. A heater chip as set forth in claim 25, wherein said heating element and said conductors are formed on said second layer.

27. A heater chip as set forth in claim 22, wherein said second layer has a thickness of from about 1 $\mu$m to about 20 $\mu$m.

28. A heater chip as set forth in claim 22 wherein said pore size is from about 1 $\mu m^2$ to about 5 $\mu m^2$.

29. A heater chip as set forth in claim 28, wherein said second layer has a thickness of from about 1 $\mu$m to about 2.5 $\mu$m.

30. A heater chip as set forth in claim 22, wherein at least one of said first and second layers is formed from a material selected from the group consisting of silicon nitride, silicon.

31. A heater chip as set forth in claim 22, wherein said second layer further includes at least one reinforcement rib positioned between two filter sections. carbide, aluminum, tantalum, and silicon dioxide.

32. A heater chip as set forth in claim 22, wherein only a portion of said second etch resistant material layer includes pores.

33. A heater chip as set forth in claim 32, wherein said second layer portion includes two or more filter sections each comprising a plurality of said pores, said second layer portion further including at least one reinforcement rib positioned between said two filter sections.

34. A printhead comprising:

a silicon main body portion having an opposing first surface and second surface and a passage extending therethrough;

a first etch resistant material layer formed on said first surface and including at least one opening which extends through said first layer and communicates with said passage;

a second etch resistant material layer integrally formed on said second surface and including a plurality of pores extending through said second layer and communicating with said passage, said second layer defining a filter which filters contaminants from ink passing through said second layer;

a plurality of heating elements formed over said silicon main body portion;

at least two conductors associated with said heating elements for providing energy to said heating elements; and a plate positioned over one of said first surface and said second surface of said silicon main body portion and including a plurality of orifices through which ink droplets are ejected, said plate flrher including a plurality of channels defining paths for ink to flow to bubble chambers after exiting said passage in said main body portion, each of said bubble chambers conmmunicating with a different one of said orifices.

35. A printhead as set forth in claim 34, wherein said heating element and said conductors are formed over said first layer.

36. A printhead as set forth in claim 35, wherein said heating element and said conductors are formed on said first layer.

37. A printhead as set forth in claim 34, wherein said heating element and said conductors are formed over said second layer.

38. A printhead as set forth in claim 37, wherein said heating element and said conductors are formed on said second layer.

39. A printhead as set forth in claim 34, wherein said pore size is from about 0.5 $\mu m^2$ to about 25 $\mu m^2$.

40. A printhead as set forth in claim 34, wherein said second layer has a thickness of from about 1 $\mu m$ to about 20 $\mu m$.

41. A printhead as set forth in claim 34, wherein said pore size is from about 1 $\mu m^2$ to about 17 $\mu m^2$.

42. A printhead as set forth in claim 41, wherein said second layer has a thickness of from about 1 $\mu m$ to about 2.5 $\mu m$.

43. A printhead as set forth in claim 34, wherein said pore size is from about 1 $\mu m^2$ to about 5 $\mu m^2$.

44. A printhead as set forth in claim 43, wherein said second layer has a thickness of from about 1 $\mu m$ to about 2.5 $\mu m$.

45. A printhead as set forth in claim 34, wherein at least one of said first and second layers is formed from a material selected from the group consisting of silicon nitride, silicon carbide, aluminum, tantalum, and silicon dioxide.

46. A printhead as set forth in claim 34, wherein said second layer further includes at least one reinforcement rib positioned between two filter sections.

47. A printhead as set forth in claim 34, wherein only a portion of said second etch resistant material layer includes pores.

48. A printhead as set forth in claim 47, wherein said second layer portion includes two or more filter sections each comprising a plurality of said pores, said second layer portion further including at least one reinforcement rib positioned between said two filter sections.

* * * * *